United States Patent [19]

Awane et al.

[11] Patent Number: 4,706,794

[45] Date of Patent: Nov. 17, 1987

[54] VENDING MACHINE WITH A COMMON DISPLAY

[75] Inventors: Misao Awane; Seiji Hara; Satoshi Kobayashi, all of Saitama, Japan

[73] Assignee: Sanyo Electric Co., Ltd., Japan

[21] Appl. No.: 652,804

[22] Filed: Sep. 20, 1984

[51] Int. Cl.[4] ..... G07F 9/08

[52] U.S. Cl. ..... 194/217; 221/2; 221/6; 221/7; 364/479

[58] Field of Search ..... 194/1 N, 10, DIG. 3, 194/215, 216, 217, 219, 244; 221/2, 6, 7, 8, 129; 364/464, 478, 479; 340/365 R, 365 VL, 825.33, 825.35; 40/584

[56] References Cited

U.S. PATENT DOCUMENTS

| | | | |
|---|---|---|---|
| 3,737,070 | 6/1973 | O'Neal | 221/6 |
| 4,225,056 | 9/1980 | Flubacker | 194/1 N X |
| 4,231,105 | 10/1980 | Schuller et al. | 194/10 X |
| 4,354,613 | 10/1982 | Desai et al. | 194/2 X |
| 4,369,442 | 1/1983 | Werth et al. | 194/1 N X |
| 4,372,464 | 2/1983 | Otten | 194/10 X |
| 4,376,479 | 3/1983 | Sugimoto et al. | 194/1 N |
| 4,392,564 | 7/1983 | Hayashi | 194/1 N |

FOREIGN PATENT DOCUMENTS 161996 12/1979 Japan .

*Primary Examiner*—Joseph J. Rolla

*Assistant Examiner*—Edward S. Ammeen

*Attorney, Agent, or Firm*—Darby & Darby

[57] ABSTRACT

A vending machine includes a plurality of selection switches corresponding to a plurality of items to be sold respectively, and in response to insertion of coins and the subsequent operation of any of selection switches, the item corresponding to the selection switch is vended. A RAM is installed associatedly with a microcomputer, and this RAM contains memory areas for storing the sales quantity and the sales amount on item basis, and these data are renewed at every vending. The RAM further contains a price memory area for storing the sales price of each item. When any of selection switches is operated in ready state of the machine, the price of the item corresponding to that selection switch is read from the RAM and is displayed on the inserted-amount display. Furthermore, when a selection switch is depressed in the state when the management mode is set up, the price of the item corresponding to that switch is displayed likewise. Moreover, in response to a selective operation of the selection switch, the sales quantity and the sales amount of an arbitrary item stored in each memory area of the RAM can be displayed in the management mode. When "continuous confirmation" command is given in the management mode, the price, sales quantity or the sales amount as described above can be displayed continuously in sequence for each item.

11 Claims, 10 Drawing Figures

VENDING MACHINE WITH A COMMON DISPLAY

BACKGROUND OF THE INVENTION

1. Field of the Invention

The present invention relates to a vending machine. More specifically, the present invention relates to a so-called multi-vending type vending machine which is provided with a plurality of selection switches, which enables to sell an arbitrary item out of a plurality of items in response to the selective operation of these switches.

2. Description of the Prior Art

One example of the vending machine of this kind is disclosed for example in the U.S. Pat. No. 4,231,105 issued on Oct. 28, 1980. In this prior art, the total accumulated sales figures can be displayed for the owner or the manager of the vending machine. In this prior art, however, despite a vending machine capable of vending a plurality of items, only sales data as a whole can be displayed. Accordingly, sales amount on each item basis is not available in an exact manner.

In the invention disclosed in the Japanese Patent Laid-Open No. 161996/1979 laid-open on Dec. 22, 1979 (which is on the same invention disclosed in the U.S. patent application Ser. No. 906,234, now abandoned, applied on May 15, 1978), the accumulated data are obtainable on each item basis, and the same can be displayed. Accordingly, the actual sales state can be grasped accurately on each item basis, this brings more effective informations to the owner and the manager. In this prior art, however, specially installed switches must be used to read the accumulated data on each item basis, and accordingly, not only the configuration becomes complicated as a whole, but also the machine becomes expensive, and furthermore when the totalization is performed frequently, its maneuverability becomes a problem.

SUMMARY OF THE INVENTION

Therefore, the principal object of the present invention is to provide a vending machine which has a simpler and more economical configuration that can make sure of the accumulated data and the like on each item basis.

Another object of the present invention is to provide a vending machine of good maneuverability.

In the present invention, in order to achieve the above-mentioned objects, by using a selection switch, data of the related item, for example, the price, sales quantity, sales amount and the like can be written to and read from a memory means, for example, a RAM. That is to say, in the present invention, the memory means has a plurality of memory areas corresponding to respective vending items, and in response to an operation of any of selection switches, the corresponding one of the plurality of memory areas is addressed.

In accordance with the present invention, the selection switches can be used in common for both sales and storing or confirmation of data, and therefore extra switches can be dispensed with in comparison with the invention disclosed in the Japanese Patent Laid-Open No. 161996/1979 cited previously, and thereby a vending machine which has a simpler configuration and is economical is obtainable.

In a preferred embodiment in accordance with the present invention, data read from the RAM can be displayed by a display for displaying the inserted amount. Accordingly, in accordance with the present embodiment, another display or indicator for making sure of the price, sales quantity, sales amount or the like can be dispensed with.

In another embodiment in accordance with the present invention, a change-over means for the change-over of a normal sales mode and a management mode is installed. And, in the management mode, in response to an operation of any one of selection switches, the corresponding address of the price memory part of the RAM is accessed, and the price can be changed by entering the numeric value through an input means such as a keyboard or bar code reader. In accordance with the present embodiment, the selection switch can be used in addressing the price memory part to change the price, and therefore no other switch is required to be installed, thereby the configuration becoming simpler.

In still another embodiment in the present invention, in either of the normal vending mode and the management mode, in response to an operation of a selection switch, the indicator installed correspondingly to that selection switch is driven, and thereby it can be indicated that that selection switch has been operated. Particularly, displaying by means of such an indicator in the management mode is very effective for confirmation and setting of price, totalization of data or the like.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
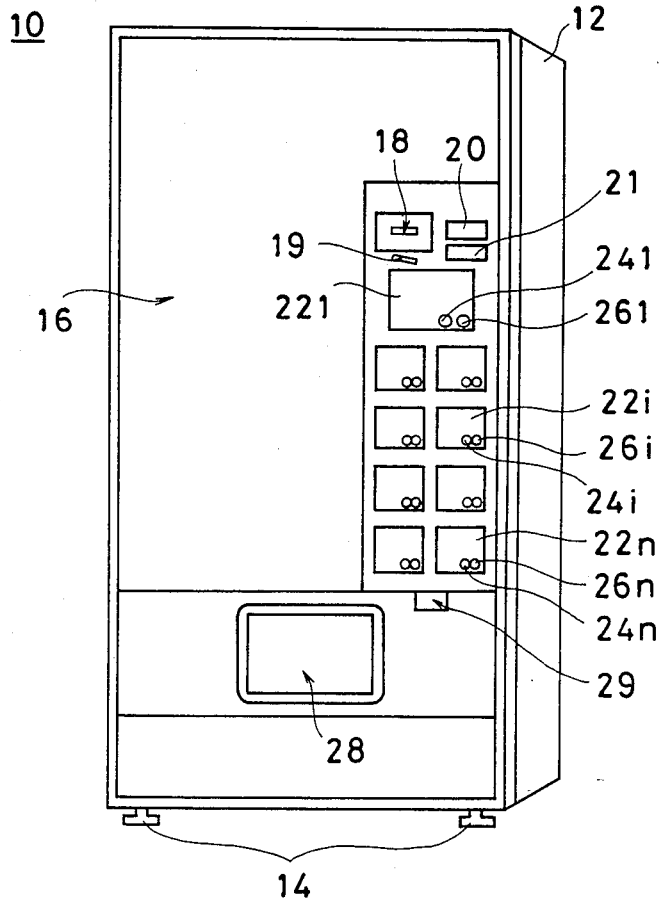
FIG. 1 is a perspective view of appearance showing one embodiment in accordance with the present invention.

FIG. 1 is an entire perspective view showing one embodiment in accordance with the present invention. The present embodiment is a vending machine capable of vending a plurality of articles or commodities. However, it is pointed out in advance that the present invention can be applied equally to a vending machine which vends such items as service and the like.

A vending machine 10 includes a housing 12, and at the bottom end of this housing 12, legs 14 for installation are provided. On the front face opening of the housing 12, a front panel 16 capable of opening and closing is mounted. On this front panel 16, a coin slot 18 is formed, and this coin slot 18 can accept the 5-cent coin, 10-cent coin, 25-cent coin, and the one-dollar coin. In relation to this coin slot 18, a bill inlet may be further installed so that the dollar bill can be inserted through it. Furthermore, a means for treating valuable media capable of treating other valuable media, for example, ticket, card and the like may be installed.

On the front panel 16, for example, a return switch 19 composed of a lever is further installed, and this return switch 19 is utilized to return the coin inserted through the coin slot 18. An amount display 20 is, for example, a digital display capable of displaying four-digit numeric values, being utilized for displaying the total amount of coins or the inserted amount. This amount display 20, as is described later, can be further utilized for displaying the price of each vending item in the normal vending mode and the management mode and for displaying the totalized data in the management mode. Under the amount display 20, a no-change indicator 21 is installed, and this no-change indicator 21 displays the comment "correct change only" when the stock of nickel, dimes and the like to be paid off for a change becomes short of or runs out.

On the front panel 16, a plurality of selection switches **22*l*–22*n* are further installed, and accordingly this vending machine 10 can vend a number (N) of items. For the selection switches 22*l*–22*n*, for example, switches of a type which contains a transparent plastic cover and is operated by depressing this cover are employed. And then, at respective positions of these selection switches 22*l*–22*n*, "on-sale" indicators 24*l*–24*n* and "sold-out" indicators 26*l*–26*n* are installed. The "on-sale" indicators 24*l*–24*n* are composed of, for example, lamps, light emitting diodes or the like, indicating that the item selected by the relevant selection switch can be vended. This "on-sale" indicating is performed only when the inserted amount is larger than the price of the commodity and also the stock of the commodity is present. The "sold-out" indicators 26*l*–26*n*** are composed of lamps or light emitting diodes likewise, indicating that the item selected by the relevant switch is in the "sold-out" state.

At the lower portion of the front panel 16, a delivery part 28 is formed, and the commodity to be vended can be taken out from this delivery part 28. A coin pay-off part 29 is formed in the vicinity of this delivery part 28, and coins to be returned or coins for the change are paid off to the coin pay-off part 29.

Figure 2:
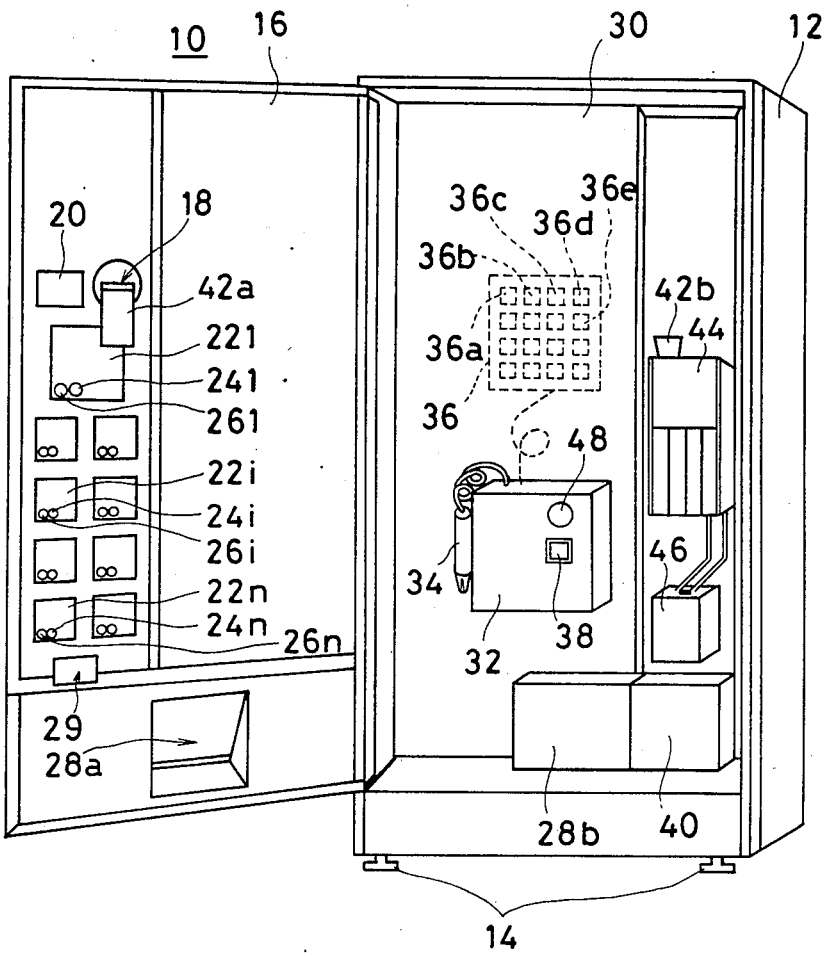
FIG. 2 is a perspective view showing a state wherein a front panel is opened in FIG. 1 embodiment.

The front panel 16 can be opened as shown in FIG. 2, and in the housing 12, an inner door 30 which also can be opened and closed freely is further mounted so as to be seen when this front panel 16 is opened. On the front face of this inner door 30, a control box 32 is mounted, and in this control box 32, electronic components required for controlling the CPU and the like are accommodated, which are explained later in reference to FIG. 4. In relation to the control box 32, a light pen 34 is installed. This light pen or bar code reader 34 is for scanning the bar code sheet (not illustrated) and reading the content of the bar code depicted thereon, forming an input unit. For the input unit, a keyboard 36 may be employed together with the light pen 34 or in place of the light pen 34. The keyboard 36 is provided with ten-key of 0–9 and relevant function keys. The function keys, for example, include a key **36*a* for confirming or setting the price, a key 36*b* for confirming the total sales quantity, a key 36*c* for confirming the sales quantity for each selection, a key 36*d* for confirming the total sales amount, a key 36*e* for confirming sales amount for each selection and the like. Furthermore, on this key board 36**, a "clear" key, "termination" key and the like are installed as required.

Furthermore, in addition to the individual function keys **36*a*–36*e*** individual on a mode basis as described above, one common function key may be installed to discriminate each mode by means of number of times of operation of this common function key. In this case, for example, one-time operation of the common function key sets the total sales quantity mode, two-time operation sets the sales quantity mode for each selection, 3-time operation sets the total sales amount mode, and 4-time operation sets the sales amount mode for each selection.

On the front face of the control box 32, a manually operable change-over switch 38 for change-over of the normal vending mode and the management mode is installed. On the front face of the control box 32, a buzzer 48 is further installed, and this buzzer 48 is, as explained later, utilized for informing the completion of preparation for inputting data.

On the rear side of the front panel 16, for example, a hollow-tube-shaped coin chute **42*a* is mounted in relation to the coin slot 18, and when the front panel 16 is closed, the bottom end part of this coin chute 42*a* corresponds to the top end part of a coin hopper 42*b* fixed at the bottom end thereof to a coin selector 44 which is installed in the housing 12. Although not illustrated, this coin selector 44 contains switches on a kind of inserted coin basis, and by closing the switch once, a signal representing insertion of one coin of the corresponding kind is given to the control box 32. Under the coin selector 44, a coin stocker 46 is installed, and the inserted coins passing through the coin selector 44 are stocked in this coin stocker 46**, and the stocked coins are recovered by the owner or manager or are utilized appropriately for the change.

On the front panel 16, an opening **28*a* communicating with the delivery part 28 as shown in FIG. 1 is formed, and articles or comodities are discharged into the delivery part 28 through the opening 28*a*. When the front panel 16 is closed, the opening 28*a* is further communicated to a path 28*b* formed beneath the control box 32. In the housing 12, a power supply 40 is further installed under the coin stocker 46, and this power supply 40 supplies the control box 32** and other necessary places with DC or AC power.

Figure 3:
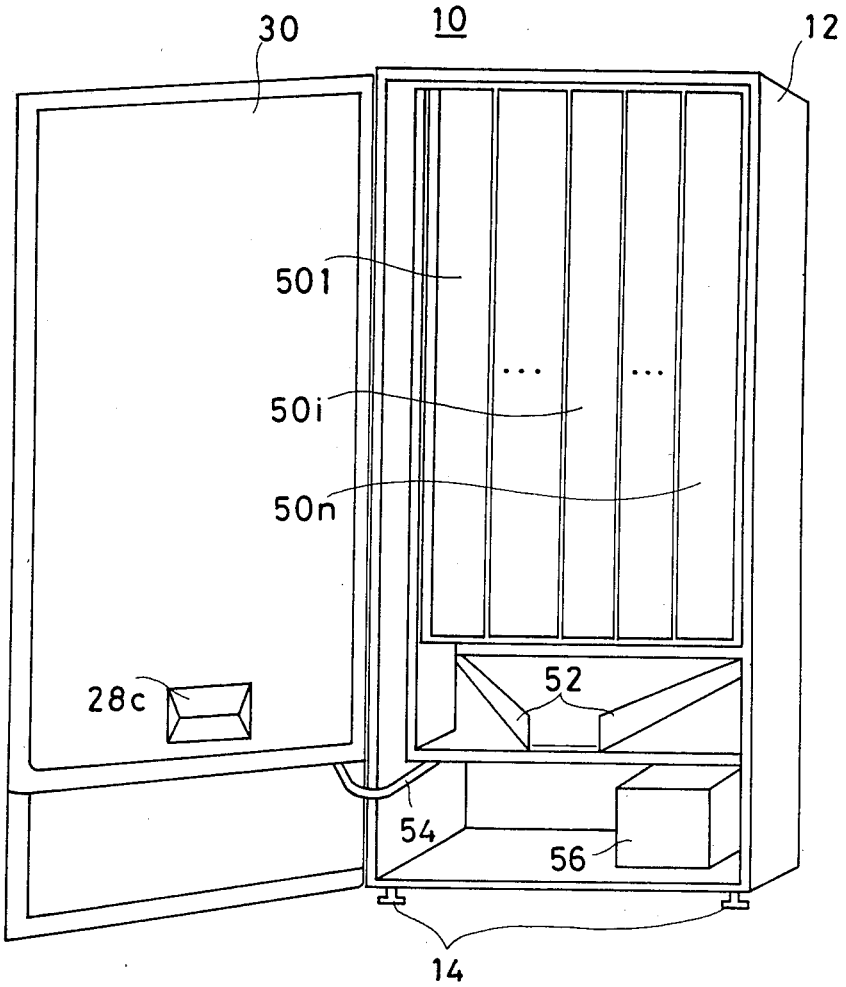
FIG. 3 is a perspective view showing a state wherein an inner door is opened in FIG. 1 embodiment.

As shown in FIG. 3, when the inner door 30 is opened, a plurality of columns **50*l*–50*n* extending in the direction of the height of the automatic vending machine 10 are formed. In general, the columns 50*l*–50*n* are formed by the number equal to that of the selection switches 22*l*–22*n* (FIG. 1**) like the embodiment described hereinafter, and different kinds of articles or commodities are stocked in respective columns. However, the number of these columns is sometimes larger than that of the selection switches. In this case, salable commodities are accommodated, for example, in two columns, and by depressing one common selection switch, commodities of the same kind are discharged alternately from the two columns.

A vending chute 52 is installed under the columns **50*l*–50*n* to vend commodities, and this vending chute 52 is formed at the bottom part of this inner door 30 in the state wherein the inner door 30 is closed, also positionally corresponding to the path 28*b* communicating with the opening 28*a* of the front panel 16. In the housing 12, a means for taking out commodities containing, for example, a motor and other components is installed (not illustrated) in relation to the respective columns 50*l*–50*n*. To supply this means for taking out commodities (not illustrated) with signals and power, a cable 54 is wired which extends from the control box 32 and the power supply 40 (FIG. 2**).

In the housing 12, a cooler unit 56 for cooling commodities, for example, cola, juice and the like accommodated in the columns 50*l*–50*n* is further installed.

Figure 4:
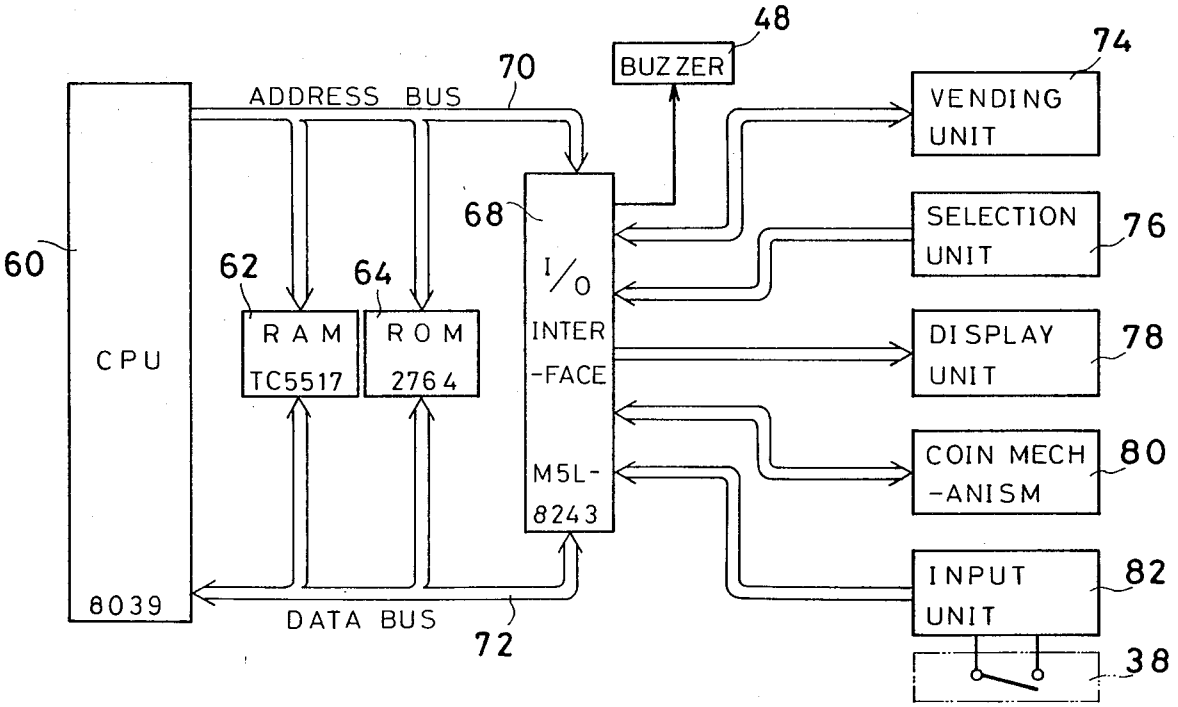
FIG. 4 is a schematic block diagram showing a circuit configuration of this embodiment.

FIG. 4 is a block diagram for explaining an electric circuit configuration of one embodiment in accordance with the present invention. For example, the "8039" manufactured by Intel can be utilized for a CPU 60, for example, the "TC 5517" manufactured by Toshiba can be utilized for a RAM 62, for example, the "2764" manufactured by Intel can be utilized for a ROM 64, for example, and the "M5L8243" manufactured by Mitsubishi can be utilized for an I/O interface 68. These components 60, 62, 64 and 68 are connected by means of an address bus 70 and a data bus 72.

A vending unit 74 is further connected to the I/O interface 68. This vending unit 74 is installed in relation to the respective columns 50*l*–50*n*. In addition, the detailed configurations of this vending unit 74 and other means or units which are described hereinafter are disclosed in FIG. 10 in the U.S. patent application Ser. No. 592,410 titled "AN INPUT UNIT OF AN AUTOMATIC VENDING MACHINE" which was filed on Mar. 23, 1984 and was assigned to the same assignee, and therefore the detail explanation is incorporated into here by citing.

The vending unit 74 contains motors for the respective columns 50*l*–50*n* (FIG. 3), and the CPU 60 gives the vending command to these motors (not illustrated) through the I/O interface 68, and also a signal is inputted to the CPU 60 from this vending unit 74 through the I/O interface 68 at every vending.

A selection unit 76 comprises the selection switches 22*l*–22*n* (FIG. 1) and so on, and from this unit 76, a signal representing that the selection switch has been operated is inputted to the CPU 60 through the I/O interface 68. A display unit 78 comprises the amount display 20, the no-change indicator 21, the "on-sale" indicators 24*l*–24*n*, and the "sold-out" indicators 26*l*–26*n*. The display unit 78 is controlled by the CPU 60 through the I/O interface 68.

A coin mechanism 80 comprises the coin selector 44, the coin stocker 46, the coin pay-off unit (not illustrated) and so on, and the kind and number of inserted coins are inputted to the CPU 60 from this coin mechanism 80 through the I/O interface 68, and also a command signal for paying off required coins is given to this coin mechanism 80 from the CPU 60.

An input unit 82 comprises the light pen or the bar code reader 34 and/or the keyboard 36, and input data from this input unit 82 are inputted to the CPU 60 through the I/O interface 68. And, the change-over switch 38 is installed in relation to the input unit 82, and this change-over switch 38 is utilized for change-over of the normal vending mode and the management mode as described previously.

The buzzer 48 is connected to the I/O interface 68.

Figure 5:
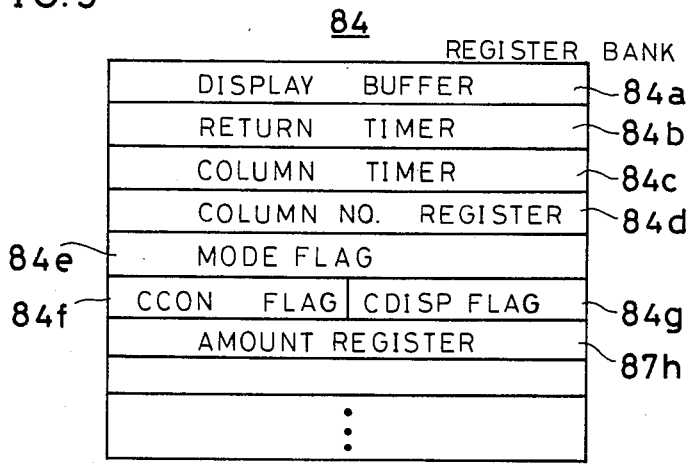
FIG. 5 is an illustration view showing a register bank contained in the CPU in FIG. 4.

The CPU 60 contains a register bank 84 as shown in FIG. 5. In the register bank 84, a display buffer 84*a* is formed, and display data for the display unit 78 (FIG. 4), that is, the amount display 20, the "on-sale" indicators 24*l*–24*n* and the "sold-out" indicators 26*l*–26*n* are loaded in this display buffer 84*a*. Numeric information is loaded, for example, as 4-digit numeric data, and information of lighting or putting-out of the indicator is loaded as "1" or "0" of one bit for one indicator. A return timer 84*b* and a column timer 84*c* are formed in the register bank 84. The return timer 84*b* is a timer for making the machine return automatically to the ready state, that is, the normal vending mode when no data is inputted for a certain time in the management mode as described later. The column timer 84*c* provides the address change time in performing sequential increment (or decrement) of the column, namely, the memory area (address) of the RAM 62 in the continuous confirmation mode as described later. A column register 84*d* is formed in the register bank 84, and this column register 84*d* stores the number of the column, namely, selection specified at that time. A mode flag 84*e* formed in the register bank 84 is composed of a plurality-digit registers, and flag data for discriminating respective modes in the management mode, for example, "price", "sales totalization", "continuous confirmation", "totalization clear" or "termination" mode can be set. This flag data of each mode is the leading address of the relevant memory area of the RAM 62, and the mode data set in this mode flag register 84*e* becomes a reference of address of the item associated with each column, namely, selection switch.

A CCON flag 84*f* is set in the "continuous confirmation" mode wherein the price or totalization data can be continuously confirmed automatically in the column sequence, that is, in the selection sequence, being reset after the data of the final column has been displayed. A CDISP flag 84*g* is a flag for enabling the selection switches 22*l*–22*n* (FIG. 1) in the management mode, being utilized for controlling ON or OFF of the indicators 24*l*–24*n* and/or 26*l*–26*n* which are installed in relation to each selection switch. The register bank 84 further contains an amount register 84*h*, and this amount register 84*h* is utilized for storing the total amount of inserted coins. In the register bank 84, in addition to the above, address registers wherein the address data of the RAM 62 are loaded, registers for storing the kind and number of inserted coins, and other flag areas are formed.

Figure 6:
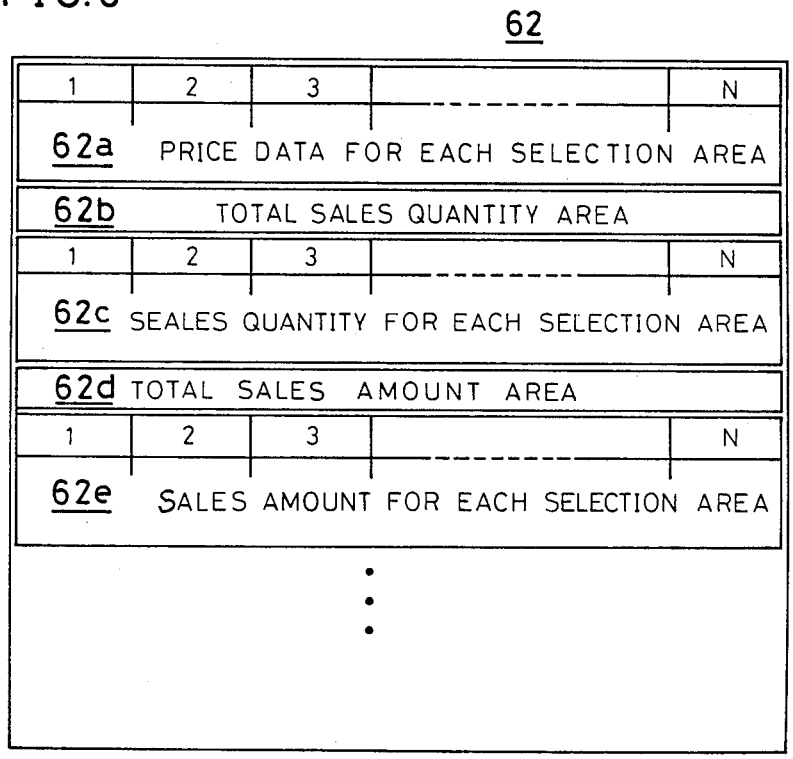
FIG. 6 is an illustration view showing memory areas of the RAM in FIG. 4.

FIG. 6 is a schematic view showing a memory format of the RAM. At least five areas 62*a*, 62*b*, 62*c*, 62*d* and 62*e* are formed in the RAM 62. The area 62*a* is an area for storing the price data for each selection switch, containing number (N) of addresses corresponding to the number of the selection switches 22*l*–22*n*. The area 62*b* is an area for storing the total sales quantity, and the area 62*c* is an area for storing the sales quantity for each column, that is, for each selection switch, containing number (N) of addresses which is equal to the number of the selection switches. The area 62*d* is an area for storing the total sales amount, and the area 62*e* is an area for storing the sales amount for each column, that is, for each selection switch, having number (N) of addresses which is equal to the number of the selection switches 22*l*–22*n*.

Figure 7A:
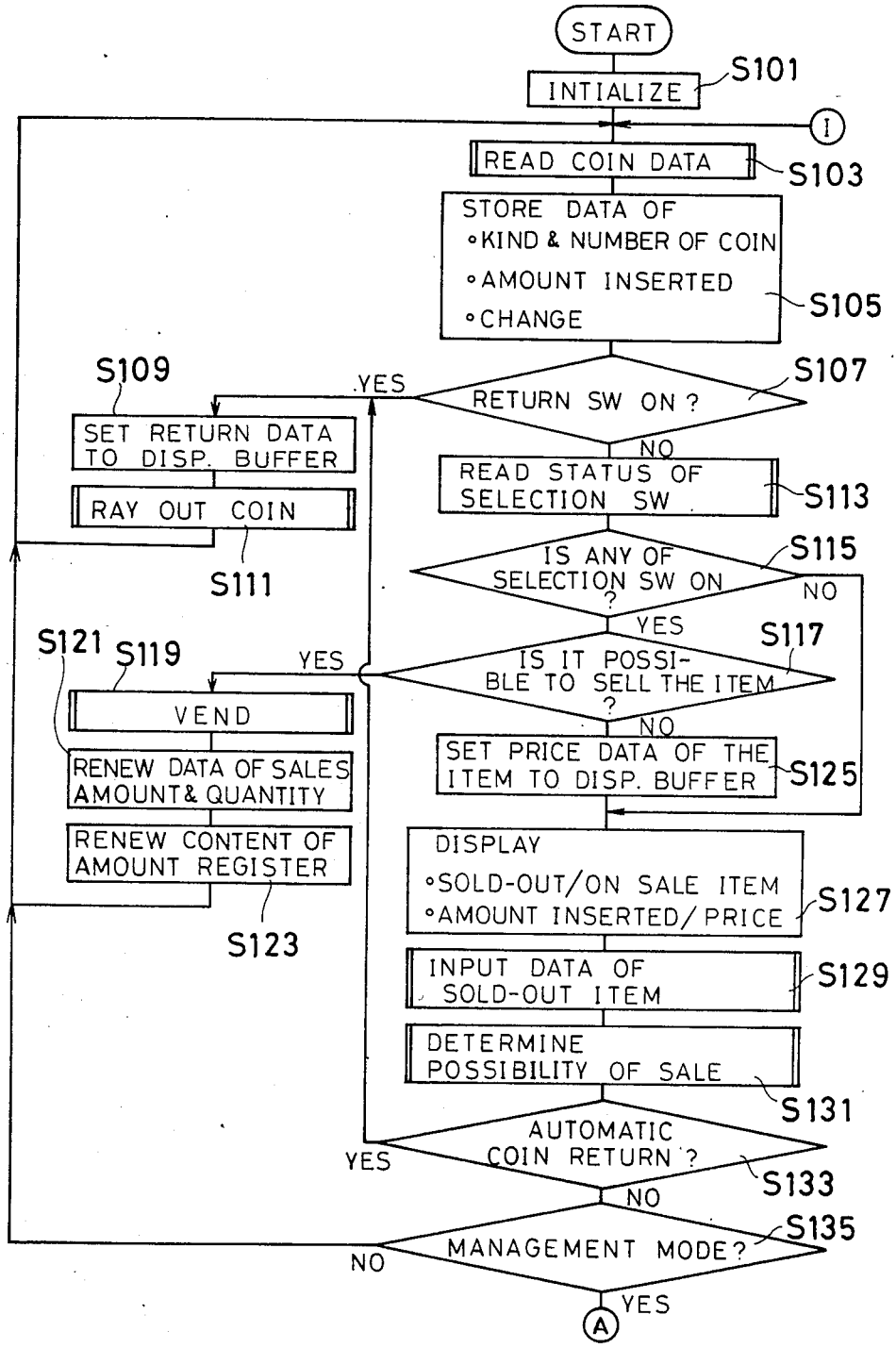
FIG. 7A through FIG. 7D are flow charts for explaining operations of the present embodiment.
Figure 7B:
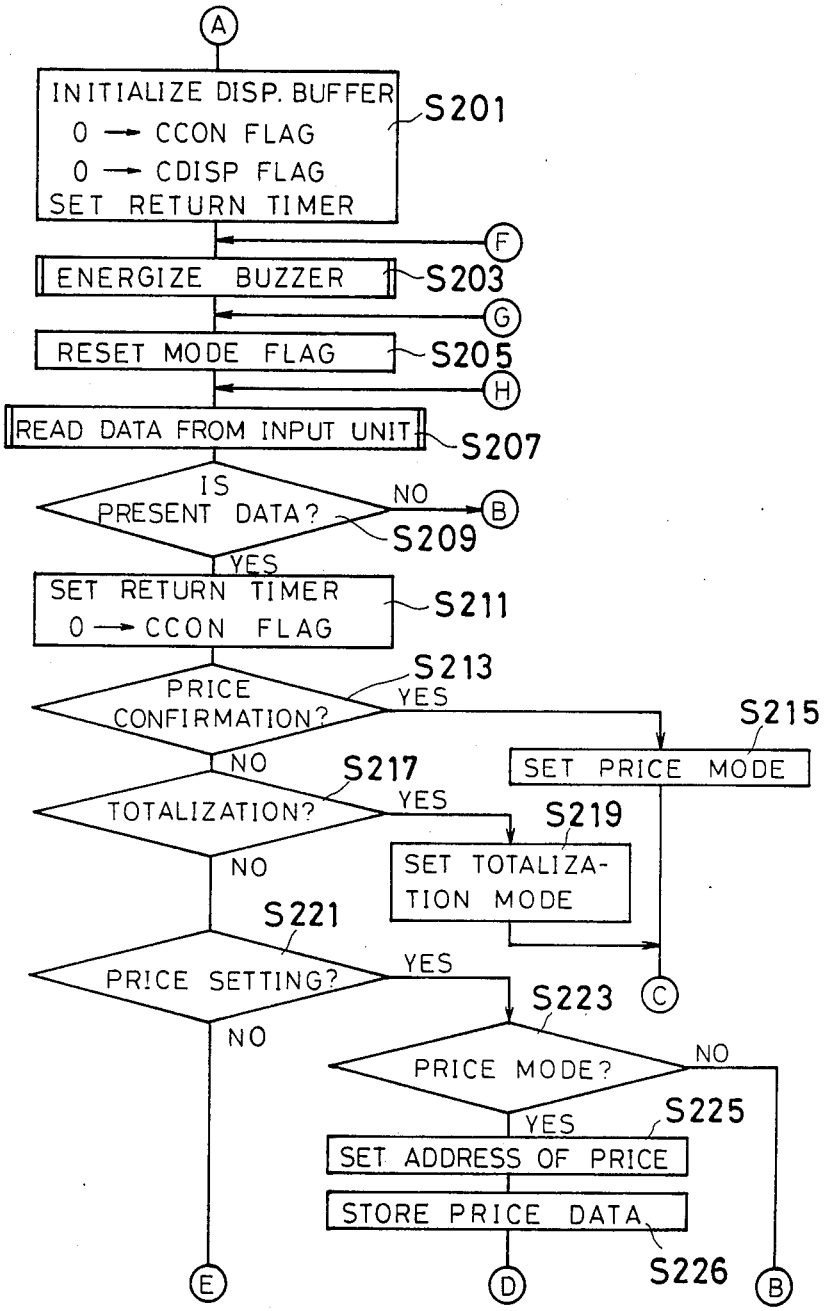
Figure 7C:
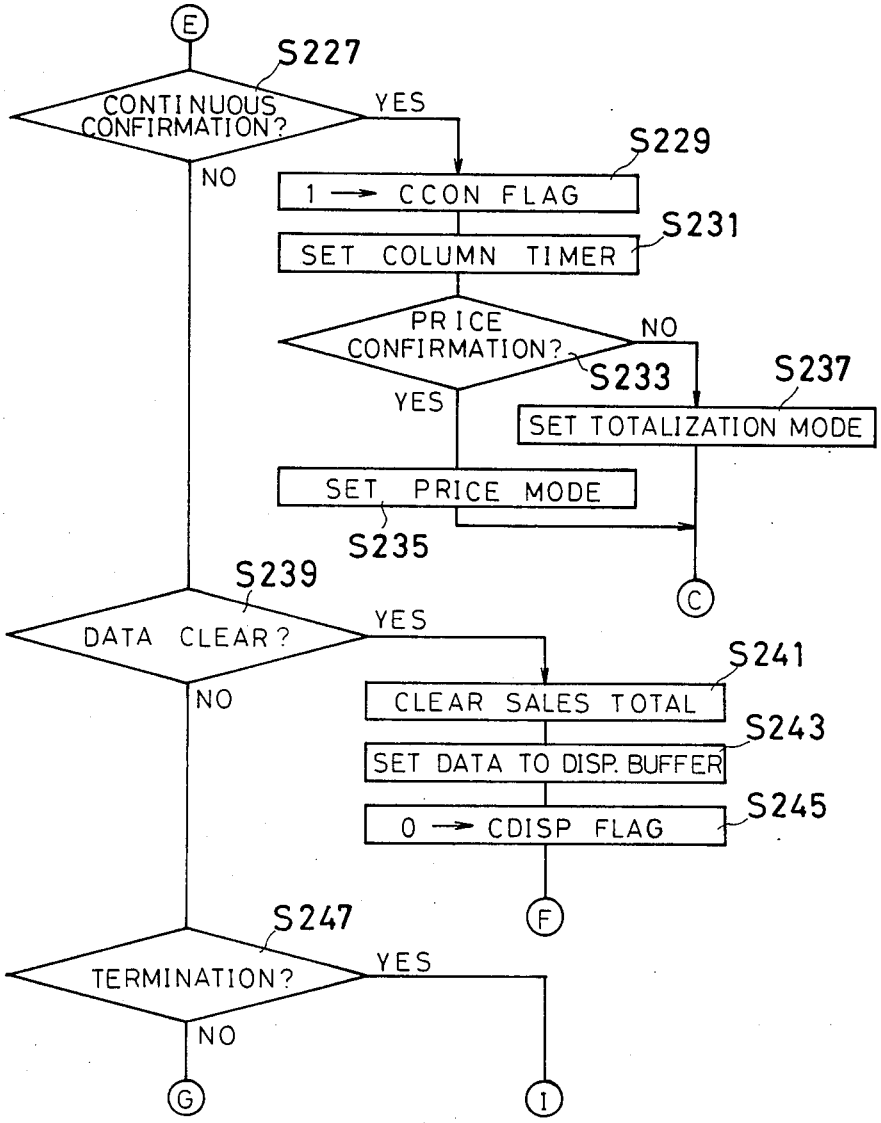
Figure 7D:
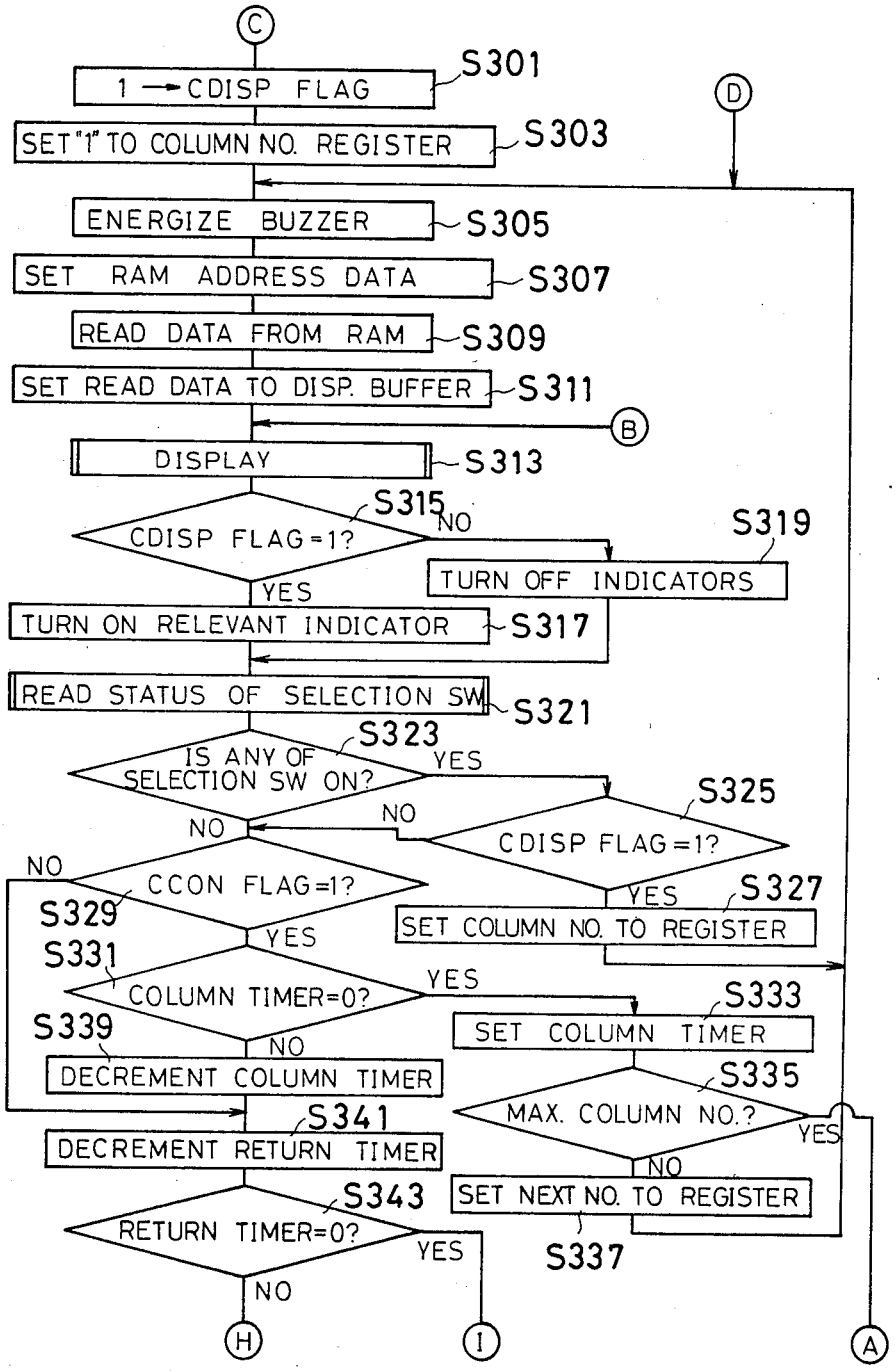

Next, description is made on operation of the present embodiment in reference to FIG. 1 through FIG. 6 and FIG. 7A through FIG. 7D. FIG. 7A principally shows operation in the normal vending mode, and FIG. 7B through FIG. 7D show operation in the management mode.

In reference to FIG. 7A, initialization is performed in the first step S101. In the next step 103, the CPU 60 reads the coin data from the coin mechanism 80. And then, the coin data which has been read are loaded in the relevant register of the register bank 84 in the next step S105. That is to say, in the step S105, the kind and number of inserted coins are stored in the relevant register (not illustrated) in the register bank 84. Based on the kind and number of coins, the CPU 60 calculates the inserted amount, and that amount is stored in the amount register 84*h* (FIG. 5). In this step S105, the change data is further stored in the relevant register (not illustrated) of the register bank 84, and this change data, for example, contains the kind and number of coins which can be paid off as the change. Thereafter in the step S107, the CPU 60 decides whether or not the return switch 19 has been operated based on the data from the input unit 82.

If it is detected that the return switch 19 has been operated in the step S107, the return data is set in the display buffer 84*a* (FIG. 5) in the following step S109. Accordingly, at this time, the amount to be paid back is displayed on the amount display 20. And then, in the step S111, the CPU 60 gives a command to the coin mechanism 80, and responsively this coin mechanism 80 is operated and coins of the displayed amount are paid off into the coin pay-off part 29 (FIG. 1).

If the return switch 19 is not turned -on, the CPU 60 reads the states of the selection switches 22*l*–22*n* based on the data from the selection unit 76 in the next step S113. And then, in the step S115, decision is made on whether or not any of the selection switches is turned -on. If any selection switch is turned -on, the processing proceeds to the step S117, and if none of the selection switches is turned -on, the processing proceeds to the step S127. In the step S117, decision is made on whether or not the commodity or item corresponding to the selection switch which has been turned -on can be vended. More specifically, decision is made to be capable of vending only when the inserted amount is larger compared with the price of the item.

When "capable of vending" is detected in the step S117, the CPU 60 gives a command to the vending unit 74 in the next step S119, and responsively the vending unit 74 is operated and the commodity is discharged to the delivery part 28 (FIG. 1), for example, from the column 50*i* corresponding to the selection switch 22*i* which has been turned -on through the vending chute 52, the opening 28*c*, the path 28*b* and the openings 28*a*. Thereafter, the CPU 60 renews the data of the sales amount and the sales quantity stored in the RAM 62 in the step S121, also renewing the content of the amount register 84*h* in the step S123. In the step S123, concretely, the price of the sold item is subtracted from the inserted amount, and the result is stored again in the amount register 84*h*. And then, the residual is paid off as the change, or the next commodity selection is made possible.

When the CPU 60 detects "incapable of vending" in the step S117, the CPU 60 reads the price data of the item of the selection switch, for example, 22*i* from the relevant address of the RAM 62 in the step Example, setting that price data in the display buffer 84*a*. In the next step S127, the data is given to the display unit 78. That is, in this step S127, when any of the selection switches is turned -on, the price of the item corresponding to that switch is displayed by the amount display 20, and when none of the selection switches is turned -on, the inserted amount is displayed by the amount display 20. In either case, the "on-sale" indicators 24*l*–24*n* and the "sold-out" indicators 26*l*–26*n* are lighted or put out, respectively.

In the next step S129, the CPU 60 receives the data from the vending unit 74 and makes the data of the "sold-out" item to be stored in the relevant register (not illustrated) of the register bank 84. In the step S131, the CPU 60 decides the possibility of vending for each item. More specifically, in this step S131, the CPU 60 decides the items which can be vended at the inserted amount based on the price, the sold-out state and the no-change state for the item corresponding to each selection switch, making that data to be stored in the relevant register of the register bank 84. In the step S133, decision is made on whether or not coins are required to be returned automatically. Even if the inserted amount is larger than the highest price, automatic pay-back is required when vending is impossible for all the times, and if the residual amount shown in the amount register 84*h* is smaller than the lowest price after completing vending, automatic pay-back is required. In the step S133, decision is made on these matters, and if automatic pay-back is required, the processing proceeds to the step S109, and if not required, the CPU 60 decides whether or not the management mode has been set in the step S135. This setting of the management mode is performed by operating the change-over switch 38 (FIG. 1 and FIG. 4). If the management mode has not been set, the processing goes back to the step S103 like the procedure after the step S111 or the step S123 has been executed. If the management mode has been set, the processing moves to the management mode as shown in FIG. 7B through FIG. 7D.

Meanwhile, change-over to the management mode can be made by reading the bar code data for the management mode by means of the bar code reader 34 in place of operating the switch 38 as described above. Also, FIG. 7B and FIG. 7C principally show operation in each mode contained in the management mode and FIG. 7D principally shows common operation in each mode.

In reference to FIG. 7B, in the first step S201 of the management mode, initialization is performed. That is to say, in this step S201, the display buffer 84*a* (FIG. 5) is initialized, both the CCON flag 84*f* and the CDISP flag 84*g* are reset, and "0" is written. At the same time, in this step S201, the return timer 84*b* (FIG. 5) is reset. After initialization is completed as described above, the buzzer 48 (FIG. 2 and FIG. 4) is energized in the following step S203 to inform the operator of completion of initialization of the management mode. In the next step S205, the mode flag 84*e* (FIG. 5) is reset, and in the step S207, the CPU 60 reads the data from the input unit 82. And then, if input data is present, the processing proceeds to respective modes, but if no data is present, it becomes the state of waiting input.

Input waiting;

When it is detected that no data is inputted from the input unit 82 in the step S209, the processing jumps to the step S313 as shown in FIG. 7D. In the step S313, display is performed by the display unit 78. And then, in the following step S315, decision is made on whether or not the CDISP flag is "1", but in the input-waiting state, the flag 84*g* is not set, and accordingly, processing proceeds to the step S319. In this step S319, the indicators 24*l*–24*n* and 26*l*–26*n* are turned -off. Then, in the step S321, the CPU 60 reads the states of the selection switches 22*l*–22*n* based on the data from the selection unit 76. In the step S323, decision is made on whether or not any of the selection switches is turned -on. None of the selection switches is turned -on in the input-waiting state, and accordingly the step S329 is executed next. In this step S329, decision is made on whether or not the CCON flag 84*f* is set, but this flag 84*f* is not set in the input-waiting state, and accordingly the processing proceeds to the step S341. In this step S341, decrement of the return timer 84*b* set in the initial step S201 (FIG. 7B) is performed, and in the next step S343, the CPU 60 decides whether or not the count of the return timer 84*b* has become zero, that is, whether or not the set time of the return timer 84*b* is up. When the set time of the return timer 84*b* is up, the processing moves to the step S103 as shown in FIG. 7A, automatic change-over to the normal vending mode is performed. That is, in this input-waiting state, if no data is inputted within a certain time which is counted by the return timer 84*b* from the movement to the management mode, change-over is made to the normal vending mode. Price confirmation In order to execute the price confirmation mode, the operator has only to scan the bar code for that mode by the bar code reader 34 or to turn -on the function key 36*a* contained in the keyboard 36. When either of the above operations is performed, "YES" is decided in the step S209 as shown in FIG. 7B. Accordingly, the CPU 60 sets the return timer 84*b* and also write a numeric value zero to the CCON flag 84*f* in the following step S211. If decision is made to be in the price confirming mode in the step S213, the data representing the price mode, namely, the leading address of the area 62*a* of the RAM 62 as shown in FIG. 6 is set in the mode flag register 84*e* (FIG. 5) in the step S215.

Thereafter, the processing jumps to the step S301 as shown in FIG. 7D, and in this step S301, "1" is written to the CDISP flag 84*g*. Accordingly, operation of the selection switches in the subsequent processing is enabled. In the following step S303, the CPU 60 sets a numeric value 1 in the column number register 84*c* (FIG. 5). That is, in this step S303, the initial column 501, that is, the initial selection switch 22*l* is specified. And the buzzer 48 is energized in the step S305 and subsequently in the step S307, the leading address of the area 62*a* corresponding to the initial column 50*l*, that is, the initial selection switch 22*l* is set in the address register (not illustrated) contained in the register bank 84. Accordingly, in the price confirmation mode, at first the price of the item corresponding to the initial column or selection switch is read from the RAM 62 in the step S309. In the step S311, the read price data is set in the display buffer 84*a* (FIG. 5), and in the step S313, the price of the item of the initial selection switch 22*l* is displayed by the amount display 20 (FIG. 1). "1" is written to the CDISP flag 84*g* in the step S311, and therefore "YES" is decided in the step S315, and in the next step S317, the relevant indicators, that is, the indicators 24*l* and/or 26*l* corresponding to the initial column 501, that is, the selection switch 22*l* are lighted.

In this price confirmation mode, if any of the selection switches is turned -on, the processing moves to the step S325. The step 325 is the same as the previous step S315, and accordingly, the following step S327 is executed subsequently. In this step S327, for example, the number "i" of the selection switch 22*i* is set in the column number register 84*d* (FIG. 5). Thereafter, the previous steps S305, S307, S309, S311 and S313 are executed again, and the price of the item which can be vended by that selection switch 22*i* is displayed by the amount display 20 (FIG. 1). Thus, the price of an arbitrary item intended to be confirmed can be selectively displayed on the amount display 20.

Meanwhile, it is needless to say that the relevant indicators, for example, 24*i* and/or 26*i* are lighted every time the step S317 is executed also during the corresponding price is displayed by specifying of this selection switch. And, if no selection switch is operated for more than the set time of the return timer 84*b*, automatic return to the normal mode is performed via the step S343.

Sales totalization

The sales totalization mode can be set by scanning any of a plural kinds of bar code representing the sales totalization mode by the bar code reader 34 or by operating any of the function keys 36*b*–36*e* contained in the keyboard 36. If such a processing is performed, "YES" is decided in the step S217 (FIG. 7B). Accordingly, in the step S219, the CPU 60 sets the data representing the totalization mode in the mode flag 84*e* (FIG. 5). In this case, if this "sales totalization" has been set by operating the function key 36*b*, the address of the memory area 62*b* of the RAM 62 as shown in FIG. 6 is loaded in the mode flag register 84*e*. If the function key 36*c* has been operated, the leading address of the memory area 62*c* of the RAM 62 is loaded in the mode flag register 84*e*. Likewise, the address of the memory area 62*d* is loaded in response to an operation of the function key 36*d* and the leading address of the memory area 62*e* is loaded in response to an operation of the function key 36*e* respectively in the mode flag register 84*e*.

Then, like the previous price confirmation mode, the steps S301–S313 as shown in FIG. 7D are executed. Accordingly, in this mode, data from respective leading addresses of the areas 62*b*–62*e* of the RAM 62 are displayed by the amount display 20 (FIG. 1). When the "sales totalization" is set by operating the function key 36*b*, the data representing the total sales quantity from the memory area 62*b* of the RAM 62 is displayed by the amount display 20 by the initial execution of the step S313. In the case where "sales totalization" is set by operating the function key 36*c*, the sales quantity of the item which is vended by the initial column 501, that is, the selection switch 22*l* read from the leading address of the memory area 62*c* of the RAM 62 is displayed by the initial execution of the step S313. Furthermore, in the case where the function key 36*d* is operated, the data representing the total sales amount from the memory area 62*d* is displayed by the amount display 20 in the step S313. And, in the case where the "sales totalization" is set by operating the function key 36*e*, the sales amount of the item of the initial column 501 (selection switch 22*l*) read from the leading address of the memory area 62*e* of the RAM 62 can be displayed by the initial execution of the step S313.

If the sales quantity or the sales amount of the item is intended to be confirmed by operating arbitrary one of the selection switches 22*l*–22*n*, the selection switch has only to be turned -on in the step S321. When a selection switch 22*i* for any column, for example, 50*i* is turned -on, the step S327 is executed via the step S323 and the step S325. Accordingly, the corresponding address of the area 62*c* or the area 62*e* of the RAM 62 is specified, and the data of the sales quantity or sales amount of the item corresponding to the selection switch 22*i* is read from that address in the step S309. The totalization data which has been read is displayed by the amount display 20 in the step S313. In addition, in the case where the "sales totalization" is set by the function key 36*b* or 36*d*, such an operation of the selection key can be dispensed with.

If no subsequent operation of the selection switch is performed for more than a certain time which is set by the return timer 84b, automatic return to the normal vending mode is performed via the step S343.

Price setting

This mode is set in response to read of the corresponding bar code by the bar code reader 34 or to an operation of the function key 36a and ten-key of the keyboard 36. When this mode is commanded, the CPU 60 decides to be "YES" in the step S221 as shown in FIG. 7B. Accordingly, the processing moves to the step S223. In this step S223, the CPU 60 decides whether or not the price mode has been set previously. Accordingly, if no price mode is set at this time, the processing moves to the step S313 as shown in FIG. 7D, and therefore no price setting can be made. Because, the processing for writing the data of the price mode to the mode flag 84e has to be performed in the step after that. Thus, this price setting mode is so programmed that it can be executed only after the previous price confirmation mode has been executed.

When the price confirmation mode is executed previously and the price mode is set in the mode flag register 84e (FIG. 5), the CPU 60 decides to be "YES" in the step S223. Responsively, the processing moves to the step S225, and in this step S225, the address of the memory area 62a of the RAM 62 wherein the price of the item intended to be set is stored is set in the address register (not illustrated) contained in the register bank 84. Any of the selection switches are operated in the previous price confirmation mode, and thereby this address is set. In this price setting mode, the price data to be set can be inputted by scanning the bar code reader 34 or by operating ten-key contained in the keyboard 36. In the next step S226, this inputted price data is written to the address specified in the step S225. After this step S226 has been executed, the processing jumps to the steps S305 as shown in FIG. 7D. Accordingly, step S305 to S327 are executed in sequence, and the price data set as described above is displayed by the amount display 20 (FIG. 1) in the step S313.

Continuous confirmation

This mode can be set by reading the predetermined bar code by the bar code reader 34 or by operating the corresponding function key contained in the keyboard 36. When this mode is set, the CPU 60 decides to be "YES" in the step S227 as shown in FIG. 7C. Responsively, the processing moves to the step S229.

In the step S229, "1" is written to the CCON flag 34f (FIG. 5). In the next step S231, the column timer 84c contained in the register bank 84 is set. This column timer 84c is for counting the time interval of sequential data reading in the case of continuous confirmation. Then, in the step S233, the CPU 60 decides whether or not the mode is the price confirmation mode. This, as explained previously, can be decided by the data from the input unit 82. In the case of the price mode, the data representing the price mode is set in the mode flag register 84e in the step S235. If the mode is not the price confirmation mode, it is the sales totalization mode. Because, this continuous confirmation mode is only applied to either of the price confirmation mode and the sales totalization mode. Accordingly, when "NO" is decided in the step S233, the CPU 60 sets any of data representing the totalization mode as explained previously in the mode flag register 84e in the following step S237. Either the step s235 or the step s237 has been executed, the processing moves to the step S313 as shown in FIG. 7D. And then, steps s313 to S323 are executed. In this step S323, the CPU 60 decides whether or not any of the selection switches has been turned -on. However, in the continuous confirmation mode, no selection switch is required to be operated, and therefore the CPU 60 naturally decides to be "NO" in this step S323. Accordingly, the processing moves to the step S329.

In the step S329, decision is made on whether or not the CCON flag 84f is "1". Since this flag 84f is set in the previous step S229 (FIG. 7C), the next step S331 is executed. And then, in this step S331, decision is made on whether or not column timer 84c is zero. If the column timer 84c is counting zero, the CPU 60 resets that column timer 84c in the step 333.

In the next step S335, the CPU 60 decides whether or not the maximum column (selection switch) number, for example, "N" is set. If "NO" is decided in the step S335, the CPU 60 sets the next number in the column number register 84d (FIG. 5) in the following step S337. Then, the processing moves to the step S305, and this step S305 and the subsequent step S307 executed in sequences. Accordingly, in the step S313, the price or totalization data (sales quantity or sales amount) of the item of the number set in the register 84d is displayed by the amount display 20 (FIG. 1). And then, when the data corresponding to the number "N" of the column 50n, that is, the selection switch 22n is displayed and the step S335 is executed again, "YES" is decided this time in this step S335. Accordingly, the processing returns to the initial step S201 (FIG. 7B) of the management mode, becoming the input waiting state.

Furthermore, if "NO" is decided in the step S331, the CPU 60 decrements the content of the column timer 84c in the following step S339, decrementing the content of the return timer 34b in the following step S341. And, if the set time of the return timer 34b is up, then automatic return to the normal vending mode is performed. However, if the return timer 84b is not "0" and "NO" is decided in the step S343, then the processing returns to the step S207 again (FIG. 7B), becoming the input waiting state.

Furthermore, it will be easily understood that in this continuous confirmation mode, whether the price data is displayed or the sales data is displayed in the step 313 depends upon that through which step of S235 and S237 the jump to the step S313 has been performed.

If the step S239, S241, S243 and S250 as shown in FIG. 7C are executed, then the totalization data is cleared. However, this clear mode is not so important, and therefore further detailed description is omitted here.

Furthermore, in the step S247, decision is made on termination. Thus, termination of the management mode is performed by operating the change-over switch 38 (FIG. 2 and FIG. 4), by reading the bar code reader 34 (FIG. 2) the bar code representing "termination", or by operating the corresponding function key contained in the keyboard 36. Accordingly, not only automatic return to vending mode by the return timer 84b but also manual change-over from the management mode to the normal vending mode can be performed.

Although the present invention has been described and illustrated in detail, it is clearly understood that the same is by way of illustration and example only, and is not to be taken by way of limitation, the spirit and scope of the present invention being limited only by the terms of the appended claims.

What is claimed is:

1. A vending machine comprising:

a plurality of selection switches corresponding to a plurality of sales items, a valuable media insertion part accepting insertion of valuable media, value calculating means for calculating the value of said valuable media inserted through said valuable media insertion part, memory means having a plurality of price memory parts corresponding to said plurality of sales items, addressing means for addressing a corresponding one of said price memory parts of said memory means in response to operation of any one of said selection switches, price data reading means for reading price data from the corresponding one of said price memory parts addressed by said addressing means, determining means for determining whether or not an item corresponding to a selection switch operated is able to be sold based on a value calculated by said value calculating means and a price data read by said price data reading means, a numeric value display for normally displaying said value calculated by said value calculating means, and changing means for changing a content of said numeric value display so as to display said price data read by said price data reading means when said determining means determines that the item selected is not to be sold.

2. A vending machine machine in accordance with claim 1, wherein said determining means determines that the item is not able to be sold when the value calculated by said value calculating means is zero.

3. A vending machine machine in accordance with claim 2, wherein said determining means determines that the item is not able to be sold when the value calculated by said value calculating means fails to reach the price data of the item selected by said selection switch.

4. A vending machine machine in accordance with claim 1, which further comprises management mode setting means for setting a management mode.

5. A vending machine machine in accordance with claim 4, wherein said price data reading means comprises means for reading said price data in response to operation of any of said selection switches in said management mode set by said management mode setting means.

6. A vending machine comprising:

a plurality of selection switches corresponding to a plurality of sales items, valuable media insertion part accepting insertion of valuable media, value calculating means for calculating the value of said valuable media inserted through said valuable media insertion part, memory means having a plurality of special data memory areas respectively corresponding to said plurality of sales items and for storing sales totalization data for each sales item as special data, addressing means for addressing a corresponding one of said special data memory areas of said memory means in response to operation of a respective one of said selection switches, mode setting means for selectively setting a normal vending mode and a management mode, reading means for reading said sales totalization data for each sales item from the corresponding one of said special data memory area addressed by said addressing means in the management mode, a common display for displaying said value calculated by said calculating means in the normal vending mode and said special data read by said reading means in the management mode, and continuous confirmation commanding means for commanding a continuous sequential confirmation of the content of said memory areas of said memory means, and address changing means for performing sequential changes of address by said addressing means in response to a command by said continuous confirmation commanding means.

7. A vending machine as defined by claim 6, wherein said calculating means is enabled in said normal vending mode and said reading means is enabled in said normal vending mode and said management mode.

8. A vending machine as defined by claim 7, wherein said special data memory areas of said memory means include a sales totalization data memory part storing sales totalization data as said special data, and further comprises means for addressing said sales totalization data memory part of said memory means when said management mode is set by said mode setting means, and means for reading said sales totalization data from said sales totalization data memory part in the management mode set by said mode setting means, said sales totalization data read being displayed by said common display.

9. A vending machine as defined by claim 8, wherein said sales totalization data contains at least one of a total sales quantity and total sales amount.

10. A vending machine as defined by claim 8, wherein said memory areas of said memory means include a plurality of sales quantity memory parts for respectively storing data corresponding to a sales quantity of said plurality of sales items as said sales totalization data, and further comprises means for addressing said plurality of sales quantity memory parts when said management mode is set by the mode setting means, and means for reading said sales quantity data from a corresponding one of said sales quantity memory parts in response to operation by any of said selection switches in said management mode set by said mode setting means, said sales quantity data read being displayed by said common display.

11. A vending machine as defined by claim 8, wherein said memory areas of said memory means include a plurality of sales amount memory parts for storing data corresponding to a sales amount of said plurality of sales items as said sales totalization data, and further comprises means for reading the sales amount data from a corresponding one of said sales amount memory parts in response to operation of any of said selection switches in said management mode set by said mode setting means, said sales amount data read being displayed by said common display.

* * * * *